US010312601B2

(12) United States Patent
Zhai et al.

(10) Patent No.: US 10,312,601 B2
(45) Date of Patent: Jun. 4, 2019

(54) COMBINATION ANTENNA ELEMENT AND ANTENNA ARRAY

(71) Applicants: Wenyao Zhai, Kanata (CA); Halim Boutayeb, Montreal (CA); Vahid Miraftab, Kanata (CA)

(72) Inventors: Wenyao Zhai, Kanata (CA); Halim Boutayeb, Montreal (CA); Vahid Miraftab, Kanata (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 632 days.

(21) Appl. No.: 14/594,583

(22) Filed: Jan. 12, 2015

(65) Prior Publication Data

US 2016/0204509 A1 Jul. 14, 2016

(51) Int. Cl.

| | |
|---|---|
| ***H01Q 21/06*** | (2006.01) |
| ***H01Q 5/40*** | (2015.01) |
| ***H01Q 5/42*** | (2015.01) |
| ***H01Q 13/06*** | (2006.01) |
| ***H01Q 9/04*** | (2006.01) |

(52) U.S. Cl.

CPC ..... *H01Q 21/065* (2013.01); *H01Q 5/40* (2015.01); *H01Q 5/42* (2015.01); *H01Q 9/0407* (2013.01); *H01Q 13/06* (2013.01); *H01Q 21/064* (2013.01)

(58) Field of Classification Search

CPC .. H01Q 5/40; H01Q 5/42; H01Q 5/55; H01Q 13/06; H01Q 21/064; H01Q 21/065; H01Q 9/0407

See application file for complete search history.

(56) References Cited

U.S. PATENT DOCUMENTS 8,350,771 B1 * 1/2013 Zaghloul ..... H01Q 9/0435 343/700 MS
2001/0015701 A1 * 8/2001 Ito ..... H01Q 1/22 343/700 MS (Continued)

FOREIGN PATENT DOCUMENTS

CN 201673998 12/2010

OTHER PUBLICATIONS

Huawei Technologies Co., Ltd., International Patent Application No. PCT/CN2016/070661 filed Jan. 12, 2016, International Search Report and Written Opinion dated Mar. 31, 2016.

*Primary Examiner* — Dameon E Levi
*Assistant Examiner* — Jennifer F Hu

(57) ABSTRACT

A combination antenna element is provided. A first antenna element, for example a waveguide antenna, may be coupled to a waveguide feed such as a Substrate Integrated Waveguide (SIW). The waveguide antenna may be formed as an aperture at a terminus of the SIW and disposed within a Printed Circuit Board (PCB) internal layer. A second antenna element, for example a microstrip patch antenna (MPA), may be provided on an outer PCB layer, the MPA defining an interior region, the interior region being positioned in line with the first antenna element. Also in some embodiments, the second antenna element is coupled to another antenna feed such as a transmission line feed which propagates signals in a different electromagnetic propagation mode than the waveguide. The transmission line feed may be a stripline located within the waveguide. An antenna array incorporating the combination antenna element is also provided.

15 Claims, 15 Drawing Sheets

(56) References Cited

U.S. PATENT DOCUMENTS

| | | | | |
|---|---|---|---|---|
| 2004/0004571 | A1* | 1/2004 | Adachi | H01Q 1/243 343/700 MS |
| 2008/0074338 | A1 | 3/2008 | Vacanti | |
| 2010/0245204 | A1* | 9/2010 | Lee | H01Q 9/0407 343/860 |
| 2012/0293279 | A1* | 11/2012 | Gong | H01P 1/208 333/202 |
| 2014/0240186 | A1 | 8/2014 | Zhou et al. | |
| 2015/0029064 | A1* | 1/2015 | Pan | H01Q 1/22 343/720 |
| 2015/0042513 | A1* | 2/2015 | Foo | H01Q 1/246 342/368 |

* cited by examiner

COMBINATION ANTENNA ELEMENT AND ANTENNA ARRAY

CROSS-REFERENCE TO RELATED APPLICATIONS

This is the first application filed for the present technology.

FIELD OF THE INVENTION

The present invention pertains to the field of antennas and in particular to a combination antenna element and antenna array.

BACKGROUND

Antenna systems capable of operating in multiple frequency bands are desirable for reasons such as system agility and high bandwidth. However, due to size limitations, different antenna elements corresponding to different frequency bands are often required in close physical proximity to one another. One approach to such systems is to distribute the radiators pertaining to various sub-arrays in an interleaved manner over a given area, so as to avoid confining each sub-array to a small area.

A difficulty with the above is that antenna elements appropriate to different frequency bands typically have significantly different size requirements, which makes element interleaving problematic. A further difficulty is that antenna arrays appropriate to different frequency bands typically have significantly different inter-element spacing requirements, which makes array interleaving problematic. A further difficulty is that even when different sets of elements operate in different frequency bands, the presence of one set of elements can negatively impact the performance of another.

Therefore there is a need for dual-mode, dual-band antenna systems that are not subject to one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

An object of the present invention is to provide a combination antenna element and antenna array. In accordance with an aspect of the present invention, there is provided a combination antenna element having a first antenna element and a second antenna element. The first antenna element is coupled to a first antenna feed and operates in a corresponding first frequency band, while the second antenna element is coupled to a second antenna feed and operates in a corresponding second frequency band. Further, the second antenna element includes a perimeter defining an interior region. The perimeter is such that at least a portion of the first antenna element is aligned with the interior region.

In accordance with another aspect of the present invention, there is provided a combination antenna element having both a waveguide antenna element and a patch antenna element. The waveguide antenna element is coupled to a first antenna feed and operates in a first frequency band. Further, the first antenna feed propagates first signals according to a first electromagnetic propagation mode. The patch antenna element proximate to the waveguide antenna element, is coupled to a second antenna feed and operates in a second frequency band. Further, the second antenna feed propagates second signals according to a second, different electromagnetic propagation mode.

In accordance with yet another aspect of the present invention, there is provided a method for wireless communication. The method includes operating a waveguide antenna element of a combination antenna element by passing a first signal between the waveguide antenna element and a first antenna feed. In particular, the first antenna feed propagates signals according to a first electromagnetic propagation mode, and the waveguide antenna element is operative in a first frequency band. The method also includes operating a patch antenna element of the combination antenna element by passing a second signal between the patch antenna element and a second antenna feed. In particular the second antenna feed propagates second signals according to a second, different electromagnetic propagation mode. Further, the patch antenna element is operative in second frequency band which may be different from the first frequency band.

In accordance with yet another aspect of the present invention, there is provided an antenna array having one or more combination antenna elements interspersed with one or more additional antenna elements. The combination elements each include a first antenna element configured for operative coupling to a first antenna feed and a second antenna element configured for operative coupling to a second antenna feed. The first and second antenna elements are operative in first and second frequency bands, respectively. The second antenna element includes a perimeter defining an interior region. At least a portion of the first antenna element is aligned with the interior region.

In accordance with yet another aspect of the present invention, there is provided a wireless device, such as a hand held wireless device or a wireless router. The wireless device includes a combination antenna element including a first antenna element and a second antenna element. The first antenna element is configured for operative coupling to a first antenna feed and operative in a first frequency band. The second antenna element is configured for operative coupling to a second antenna feed and operative in a second frequency band. Further, the second antenna element includes a perimeter defining an interior region. At least a portion of the first antenna element is aligned with the interior region.

BRIEF DESCRIPTION OF THE FIGURES

Further features and advantages of the present invention will become apparent from the following detailed description, taken in combination with the appended drawings, in which.

It will be noted that throughout the appended drawings, like features are identified by like reference numerals.

DETAILED DESCRIPTION

Definitions

Figure 1A:
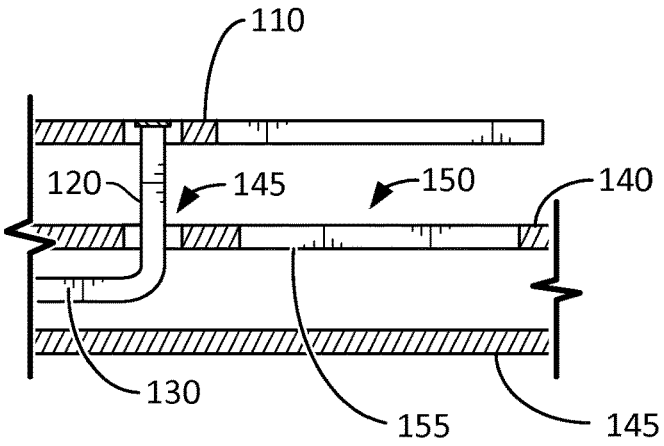
FIG. 1A illustrates an elevation view of a combination antenna element provided in accordance with some embodiments of the present invention.

As used herein, the term "about" refers to a +/−10% variation from the nominal value. It is to be understood that such a variation is always included in a given value provided herein, whether or not it is specifically referred to.

Unless defined otherwise, all technical and scientific terms used herein have the same meaning as commonly understood by one of ordinary skill in the art to which this invention belongs.

Various embodiments of the present invention incorporate or utilize one or both of a waveguide structure and a multi-conductor transmission line structure, which correspond to two different types of signal transmission structures. In some embodiments, these structures are implemented using Printed Circuit Board (PCB) features. For example, the waveguide structure may include a Substrate Integrated Waveguide (SIW) and the multi-conductor transmission line structure may include a stripline, microstrip, or like structure. As will be readily understood by a worker skilled in the art, the electromagnetic propagation mode for a waveguide may be a Transverse Electric (TE) or a Transverse Magnetic (TM) mode, whereas the electromagnetic propagation mode for a multi-conductor transmission line may be a Transverse Electromagnetic (TEM) mode or a quasi-TEM mode. The use of different modes to feed the different antenna elements may assist in isolating the different antenna elements from one another. For example, since a TEM mode and/or frequencies propagated by the corresponding multi-conductor transmission line is generally not sustained by a waveguide, the transmission line feed signal, and/or harmonics thereof, may be impeded from coupling onto the waveguide. Similarly, since the TE and TM modes may not be as readily sustained by a stripline, microstrip, or similar multi-conductor transmission line, the waveguide feed signal, and/or harmonics thereof, may be impeded from coupling onto the transmission line.

As used herein, the term "multi-conductor transmission line" refers to a signal transmission line such as a stripline, microstrip, coaxial cable, coplanar waveguide, or the like, as distinct from a waveguide which generally includes a single conductive conduit for directing electromagnetic energy. Various transmission lines may include a first conductor which is substantially linear or of limited cross section, and a second conductor which has a larger cross section and may operate as or similarly to a ground plane, the two conductors being spaced apart by a distance which facilitates signal propagation, for example in the TEM or quasi-TEM mode.

The use of a multilayer PCB-implemented waveguide and multi-conductor transmission line structures may provide a compact and cost-effective implementation means, particularly when the antenna elements are also implemented as features of a multilayer PCB. Furthermore, such a PCB implementation may be useful when the antenna array includes elements in a two-dimensional arrangement, such as a planar, rectangular grid pattern or a concentric circular pattern.

Embodiments of the present invention provide for a combination antenna element, an antenna array including such a combination antenna element, and associated methods and systems. The antenna elements may, in various embodiments, be formed from appropriate conductive features of a multilayer printed circuit board (PCB), such as features formed by etching of conductive layers, vias, and the like. Such a PCB implementation may be suitably compact for inclusion in wireless communication equipment, such as mobile communication terminals, as well as being suitable for cost-effective volume production.

Some embodiments of the present invention provide for a dual-band and co-aperture millimeter-wave (mmW) phased array antenna system, such as an array capable of communication via both a Local Multipoint Distribution Service (LMDS) frequency band, such as the 26 GHz to 31 GHz band and E-band frequency bands, such as the 71 to 76 GHz band along with the 81 to 86 GHz band. In various embodiments of the present invention, the first frequency band in which the first antenna element operates is different from the second frequency band in which the second antenna element operates. In various embodiments, the two frequency bands may be separated by a large frequency difference or a small frequency difference. In some embodiments, the two frequency bands may be at least partially overlapping.

Some embodiments of the present invention provide for a combination antenna element having a first antenna element, for example a waveguide antenna element, and a second antenna element, for example a Microstrip Patch Antenna (MPA) element. The first antenna element is configured for operative coupling to a first antenna feed and is operative in a first frequency band, for example an E-band. Likewise, the second antenna element is configured for operative coupling to a second antenna feed and is operative in a second frequency band, such as a LMDS, which may be different from the first frequency band.

Further, in various embodiments, the second antenna element includes a perimeter, such as an open perimeter, defining an interior region, such that at least a portion of the first antenna element is positioned in and/or aligned with the interior region. In this sense, alignment with the interior region may be further described, in various embodiments, by the first and second antenna elements being situated substantially within two different parallel planes, the elements aligned such that an orthogonal projection of the perimeter of the first antenna element, from the first plane to the second plane, falls within the interior region. Alternatively, the interior region may be further described, in various embodiments, by defining a pair of opposing faces of the second antenna element. The interior region corresponds to a cavity which extends from one of the opposing faces to the other and hence communicates with both opposing faces. The cavity may also communicate with a further face of the second antenna element which connects the pair of opposing faces, thereby forming the open perimeter. Further, at least a portion of the first antenna element is aligned with the cavity along a direction which is perpendicular to the pair of opposing faces.

Some embodiments of the present invention provide for a combination antenna element including a waveguide or similar antenna element and a patch antenna element in close proximity. The waveguide antenna element is configured for operative coupling to a first antenna feed, such as a waveguide, and the waveguide antenna element is operative in a first frequency band. Further, the first antenna feed propagates first signals according to a first electromagnetic propagation mode, such as a Transverse Electric (TE) or Transverse Magnetic (TM) mode. The patch antenna element is configured for operative coupling to a second antenna feed, such as a multi-conductor transmission line, and the patch antenna element is operative in a second frequency band which may be different from the first frequency band. Further, the second antenna feed propagates second signals according to a second electromagnetic propagation mode, such as a Transverse Electromagnetic (TEM) mode, which is different from the first electromagnetic propagation mode.

Furthermore, some embodiments of the present invention correspond to a combination of the above embodiments. For example, a combination antenna element according to some embodiments may include a waveguide antenna element coupled to a first antenna feed and a patch antenna element coupled to a second antenna feed, where the first antenna feed and the second antenna feed propagate signals according to different electromagnetic propagation modes. In addition the patch antenna element may include a radiating body which is shaped to have an open perimeter defining an interior region. Such an open perimeter may form the boundary of the interior region and also communicate with an exterior perimeter of the patch antenna element. An example of such a shape is a "C" shape or a crescent shape. In other embodiments, the interior region may be completely enclosed within the radiating body, and the perimeter may correspond to a closed perimeter around the interior region. An example of such a shape is an "O" shape. Furthermore, the waveguide antenna element is positioned in or aligned with the interior region.

In further embodiments, the first antenna feed may be integrated with the second antenna feed. For example, the first antenna feed may be a waveguide such as a Substrate Integrated Waveguide (SIW), and the second antenna feed may be a stripline routed within the conductive structure defined by the waveguide. As such, the stripline may be disposed inside the waveguide along at least part of its length. Where the antenna feeds are integrated into a PCB, the stripline may be formed on a conductive layer between the two conductive layers defining upper and lower boundaries of the SIW, thereby disposing the stripline inside the SIW. The stripline may further be coupled to the second antenna through a via connecting the stripline layer to the PCB layer housing the second antenna radiating body. The via may pass through a hole formed in a ground plane defining an upper surface of the waveguide. Further, the ground plane against which the second antenna radiates may be provided at least in part by the conductive layer defining the upper SIW boundary.

In some embodiments, a patch antenna element is provided in conjunction with a waveguide antenna element. However, in other embodiments the types of antenna elements are varied while still exhibiting other features as described herein. For example, in some embodiments a slot antenna, a dielectric resonator antenna (DRA) such as a slot-coupled DRA, a horn antenna, such as a horn antenna integrated into a PCB substrate, or an aperture coupled patch antenna may be used in place of the waveguide antenna. Additionally or alternatively, in some embodiments an aperture coupled patch antenna, capacitive coupled patch antenna, inductive coupled patch antenna, slot antenna, or the like, may be used in place of the microstrip or patch antenna.

Furthermore, some embodiments of the present invention provide for an antenna array including combination antenna elements as described herein. For example, the antenna array may comprise the combination antenna elements interleaved with other types of antenna elements, such as in a two-dimensional grid, to form a co-aperture antenna array. The antenna array may be a sub-array of a larger antenna array.

Furthermore, some embodiments of the present invention provide for a multilayer Printed Circuit Board (PCB) comprising an antenna array as described herein. The PCB may include, on multiple layers, etched conductive features corresponding to the combination antenna elements, additional antenna elements interleaved with the combination antenna elements, and transmission line structures for operative coupling to the combination antenna elements.

In one embodiment, the PCB may comprise, in an example order, at least an outer layer etched with a plurality of MPA elements formed in an array, a first interior layer etched with an upper ground plane of a branching SIW structure, a second interior layer etched with a branching stripline structure interior to the SIW structure, and a third interior layer etched with a lower ground plane of the branching SIW structure. The PCB further comprises blind vias operatively coupling the stripline structure to the plurality of MPA elements, the vias routed through apertures formed in the upper ground plane of the branching SIW structure. Apertures can also be formed in the upper ground plane of the branching SIW structure to provide for waveguide antenna elements. Buried vias or other structures forming parts of the waveguide antenna elements may be formed between the first layer and the outer layer. Both of the combination antenna elements and of the additional antenna elements can be interleaved with the combination antenna elements. Further, buried vias can be provided for connecting the upper and lower ground planes of the branching SIW structure for provision of the SIW.

Further, in some embodiments, the antenna array may include higher-frequency elements interleaved with lower-frequency elements, with the higher-frequency elements more closely spaced and more numerous than the lower-frequency elements. The combination antenna elements may include a higher-frequency element and a lower-frequency element. Thus the combination antenna elements may be provided with an inter-element spacing corresponding to a desired inter-element spacing of the lower-frequency elements, and with one or more higher-frequency elements located between adjacent combination antenna elements. As such, both types of elements are provided for in the array, with appropriate inter-element spacing.

For example, a two-dimensional grid-based dual-band antenna array may be provided in which the desired inter-element spacing of higher-frequency elements is x units, and the desired inter-element spacing of higher-frequency elements is y=kx units, where k is an integer greater than 1. The array may be realized as a rectangular grid with a spacing of x units, such that every $k^{th}$ row and column on the grid includes one of the combination antenna elements, and the intervening locations on the grid includes one of the higher-frequency antenna elements. As such, the inter-element spacing for both frequencies is maintained, with some locations in the grid operative at both frequencies. Notably, the combination antenna elements operate in part at the higher frequency, thereby avoiding gaps in the array of higher-frequency antenna elements at the locations of the combination antenna elements. In various embodiments, the inter-element spacing is about equal to, or at least on the same order, as half of a center operating wavelength of the type of antenna element under consideration, or alternatively a predetermined integer multiple or fraction of the operating wavelength.

It is also noted, that, in some cases, the higher-frequency elements included in the combination antenna elements may be modified versions of the other higher-frequency antenna elements situated in an antenna array between combination antenna elements.

Figure 1B:
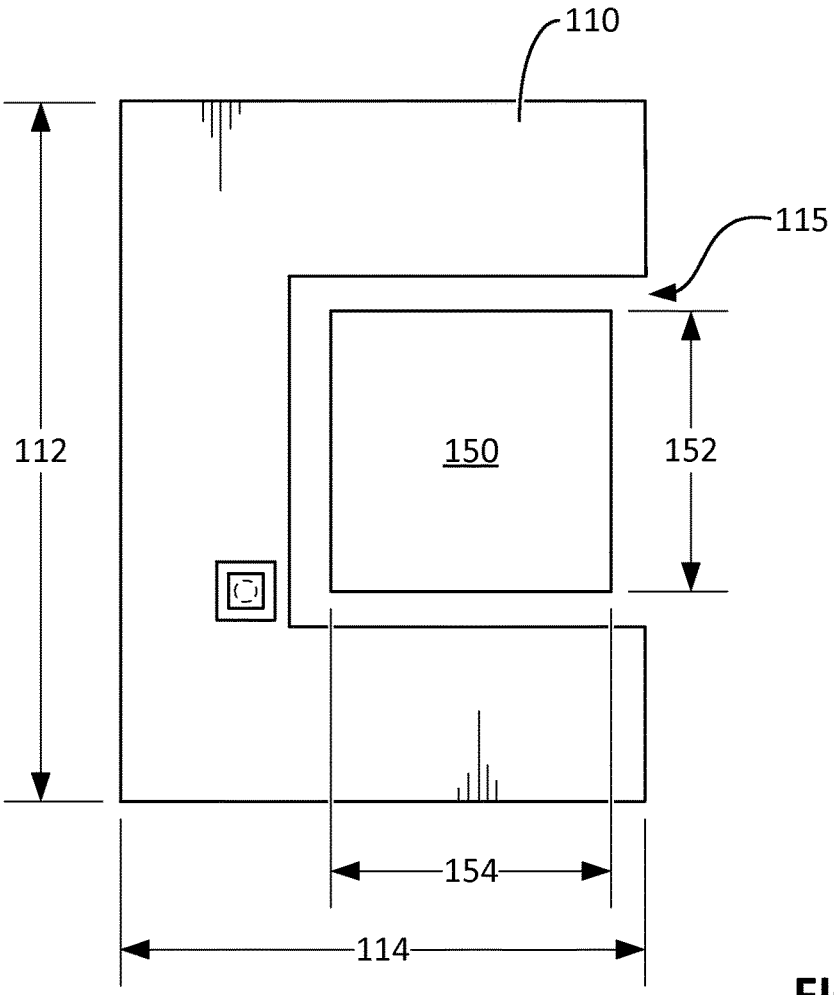
FIG. 1B illustrates a top view of the combination antenna element of FIG. 1A.

FIGS. 1A and 1B illustrate cross-sectional elevation and top views, respectively, of a combination antenna element provided in accordance with some embodiments of the present invention. The combination antenna element as illustrated is defined via suitable features of a multilayer Printed Circuit Board (PCB). However, other suitable structures may be used to implement the element. The combination antenna element includes a Microstrip Patch Antenna (MPA) element including a patch 110. As shown, the patch 110 exhibits a C shape or crescent shape when viewed from above. An open perimeter of the patch has an opening at one side to define an interior region 115. The interior region 115 is not fully enclosed by the patch in the horizontal plane of the PCB, but rather is open along one face but closed along the other three faces. The patch is operatively coupled to a via feed 120 which connects the patch 110 to a multi-conductor transmission line, illustrated as a stripline 130. The via feed may include a blind via, for example, which is routed through a slot 145 in an upper ground plane 140 associated with the stripline 130 and interposed between the stripline 130 and the patch 110. A lower ground plane 145 is also provided on an opposite side of the stripline 130, as would be readily understood by a worker skilled in the art. The stripline 130 may be coupled to other transceiver components, such as an RF front-end, amplifier, or the like.

The combination antenna element further includes a waveguide aperture antenna element 150, which is aligned with the interior region 115 defined by the patch antenna element so that the aperture antenna element 150 appears in the figure to be contained within the interior region 115 when viewed from above. The waveguide element 150 has an aperture which is located on a different plane (and hence a different layer of the PCB) than the radiating body of the MPA. When the interior region is defined as extending orthogonally into the PCB, the waveguide aperture antenna element 150 can be said to be positioned in the interior region. Alternatively the waveguide aperture antenna element 150 can be said to be aligned with the interior region of the MPA. In either case, the interior region of the MPA provides a "window" which is in line with a radiated field of the waveguide aperture antenna element, thereby substantially inhibiting the MPA from obstructing a substantial portion of the radiated field of the waveguide aperture antenna. The waveguide aperture antenna element is fed by a Substrate Integrated Waveguide (SIW) defined by the upper ground plane 140 and the lower ground plane 145, as well as a plurality of appropriately spaced vias interconnecting the two ground planes (not shown), as would be readily understood by a worker skilled in the art. Notably, the SIW and the stripline 130 share the pair of ground planes 140, 145. The aperture antenna element is defined at least in part by a slot 155 formed in the upper ground plane 140 and in line with the interior region 115. In some embodiments, the waveguide aperture antenna element 150 may include further conductive structures such as buried vias (not shown) extending upward from the upper ground plane 140 and arranged around the perimeter of the slot 155, or other conductive structures, such as interior traces, formed in PCB layers above that of the upper ground plane 140 and arranged to substantially define a conductive perimeter around the waveguide aperture antenna element 150. Such a conductive perimeter, which may be characterized as a radiating aperture of the waveguide aperture antenna element, is illustrated for example in FIGS. 7 and 9. In some embodiments, when a conductive perimeter is provided, the slot 155 may be viewed as a coupling slot between the SIW and the waveguide aperture antenna element. The conductive perimeter may have substantially the illustrated footprint 150, while the slot 155 may be reduced in size.

In one embodiment, the dimensions of the patch 110 include a length 112 of about 4.0 mm, and a width 114 of about 3.0 mm. The dimensions of the aperture antenna 150 include a length 152 of about 1.2 mm, which may be a length of the slot 155 and a width 154 of about 0.6 mm. Such dimensioning may be suitable for operation of the patch antenna element in a frequency range including 28 GHz and operation of the aperture antenna element in a frequency range including 84 GHz, when a dielectric constant $\varepsilon r$ of about 3.5 is utilized. Thus, the patch element may be suitable for LMDS while the aperture element may be suitable for E-band. Other dimensioning may be used, with a corresponding adjustment to operating frequency and dielectric materials used.

In some embodiments, the via feed location may be selected as a function of patch impedance and the input impedance of the feed. Additionally or alternatively, the via feed location may be selected such that it is as close to the line of patch's symmetry as possible to result in a desired radiation pattern. The operation bandwidth of the patch may be viewed as a function of vertical separation of PCB layer; in general the higher the dielectric thickness the higher the operating bandwidth. However increased substrate thickness may result in a substrate mode during antenna operation which may result in lowered radiation efficiency. In some embodiments, a substrate thickness of 1 mm is used.

Figure 1C:
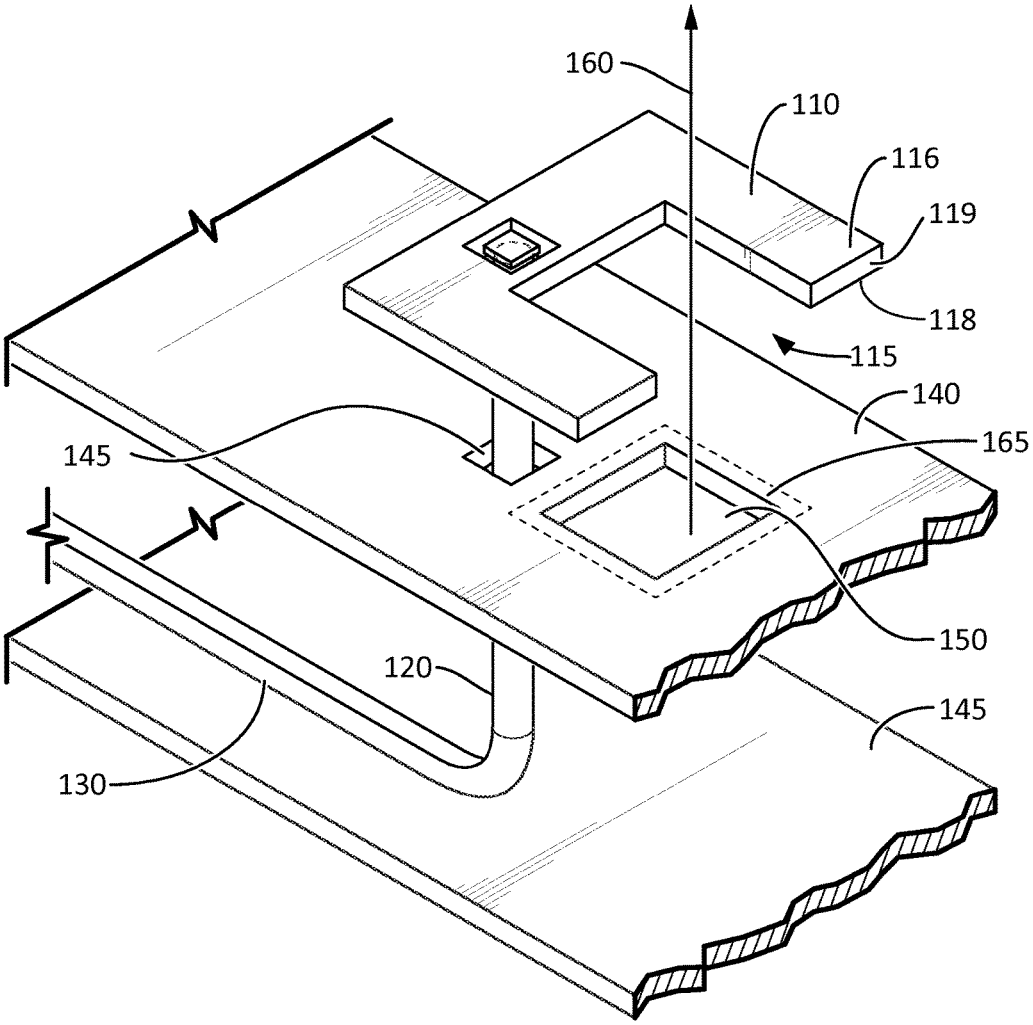
FIG. 1C illustrates a perspective view of the combination antenna element of FIGS. 1A and 1B.

FIG. 1C illustrates a perspective view of a combination antenna element provided in accordance with some embodiments of the present invention, in which the features in the vertical dimension of the page have been exaggerated for clarity. The patch 110 is coupled to the stripline 130 antenna feed by a via feed 120. The patch 110 further includes an interior region 115 which corresponds to a cavity formed in the patch. The interior region 115 communicates with a pair of opposing faces 116 and 118 of the patch 110, which are illustrated as upper and lower faces of the patch antenna element. As illustrated, the interior region 115 also communicates with a further face 119, illustrated as the right-side face of the patch antenna element. However, in other embodiments the interior region may not necessarily communicate with the further face 119 but rather may be enclosed. For example, a conductive strip may be provided along the entire face 119 to enclose the interior region 115 along all sides of the patch 110. The communication of the cavity with the three faces 116, 118 and 119 facilitates the crescent or C-shape of the patch 110.

FIG. 1C further illustrates the waveguide aperture antenna element 150 formed in the upper ground plane 140 of the waveguide. The waveguide aperture antenna element is aligned with the interior region 115 or cavity. This alignment is along a direction 160 which is substantially perpendicular to the pair of opposing faces 116 and 118. As illustrated, the entirety of the waveguide aperture antenna element 150 is aligned with the interior region 115. Thus, for example, the waveguide aperture antenna element 150 can be considered as lying within a region 165 which is defined by projecting the interior region 115 onto a plane in which the waveguide aperture antenna element 150, such as a surface of the waveguide upper ground plane 140. Alternatively, a portion of the waveguide aperture antenna element 150 may extend beyond one or more edges of the region 165. In the present embodiment, vias corresponding to a separate radiating aperture of the waveguide aperture antenna element are not illustrated.

In various embodiments, the combination antenna element includes two different types of antenna elements, such as the MPA element and the waveguide aperture antenna element. Patch antennas may be viewed as being equivalent to two slots and the coupling between two closely spaced patches may affect operation. By using different types of antenna elements in close proximity, the issue of coupling between two patch antennas may be mitigated. The waveguide aperture antenna element may exhibit generally low coupling with other antenna elements in close proximity with the sides of the waveguide for example due to the metallic walls of the waveguide.

Figure 2A:
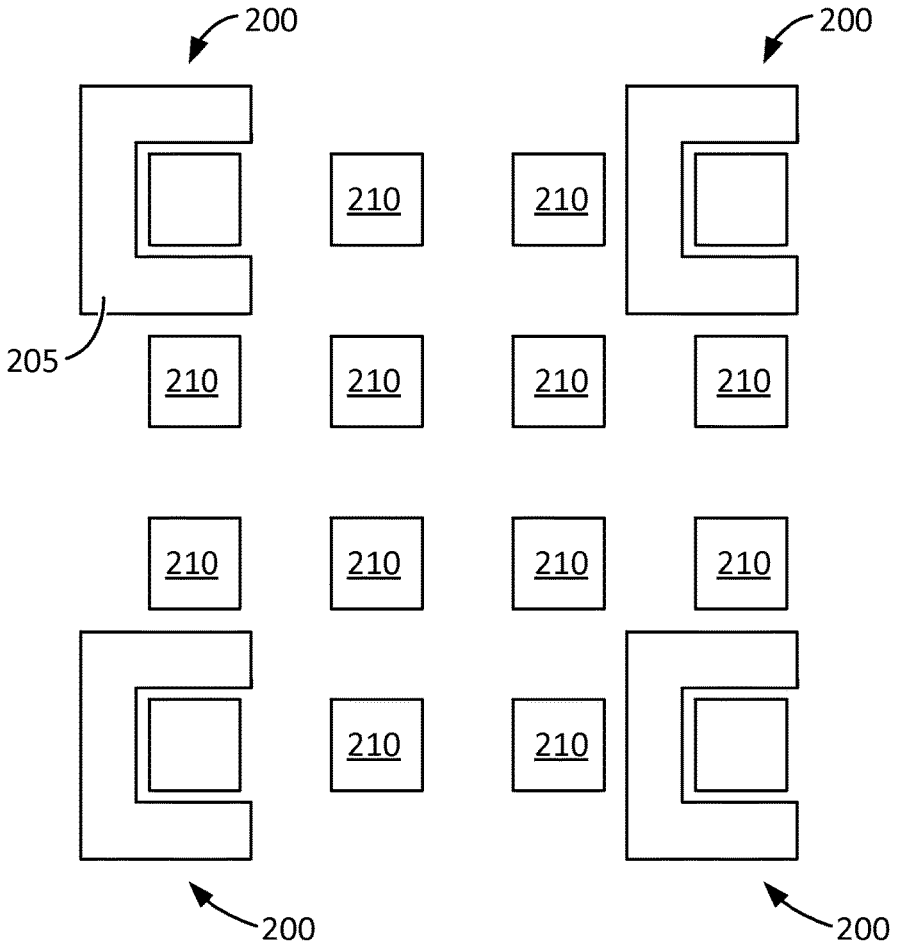
FIG. 2A illustrates a dual-band antenna array provided in accordance with some embodiments of the present invention.

FIG. 2A illustrates an antenna array or sub-array portion thereof, comprising combination antenna elements 200 interleaved with other antenna elements 210, in accordance with an embodiment of the present invention. As illustrated, every fourth element row-wise and column-wise in the array is a combination antenna element 200. Put another way, the inter-element spacing between antenna elements 210 is x units on centre, while the inter-element spacing between combination antenna elements 200 is 3x units on centre. In one embodiment, in association with the example dimensions given with respect to FIG. 1 for LMDS and E-Band operation, the inter-element spacing between antenna elements 210 is about 2.5 mm, and the inter-element spacing between combination antenna elements 200 is about 7.5 mm. Notably, the "C"-shaped component 205 of the combination antenna elements 200 is compactly configured such that it fits within the space between adjacent antenna elements 210. As such, the width across branches of the "C," that is the widths of rectangular regions forming the component 205, is restricted to be less than about 1.3 mm in the presently illustrated embodiment. In some embodiments, the widths of these regions of the component 205 is about 1 mm, which corresponds to a 2 mm by 2 mm square interior region for accommodating therein the square or rectangular waveguide antennas having edge sizes less than or equal to 1.2 mm. In some embodiments, the waveguide antennas are rectangular with edge sizes of 0.6 mm and 1.2 mm.

In some embodiments, for an antenna array application, the use of different antenna element types facilitates a reduced mutual coupling between different array elements. Thus, a MPA element and waveguide aperture antenna element may be utilized in the above illustrated embodiment. Alternatively, various other types of antenna elements may be used, provided that the first and second antenna elements of the combination antenna element are of different types.

In various embodiments, a branched transmission line structure may be used to feed the various elements of the antenna array. For example, a branched waveguide structure may be routed to each of the waveguide aperture antenna elements of the array, while a branched stripline structure embedded within the branched waveguide structure may be routed to each of the MPA elements of the array. Each of the antenna elements may be disposed at a terminus of a corresponding branch of the transmission line structure.

Figure 2B:
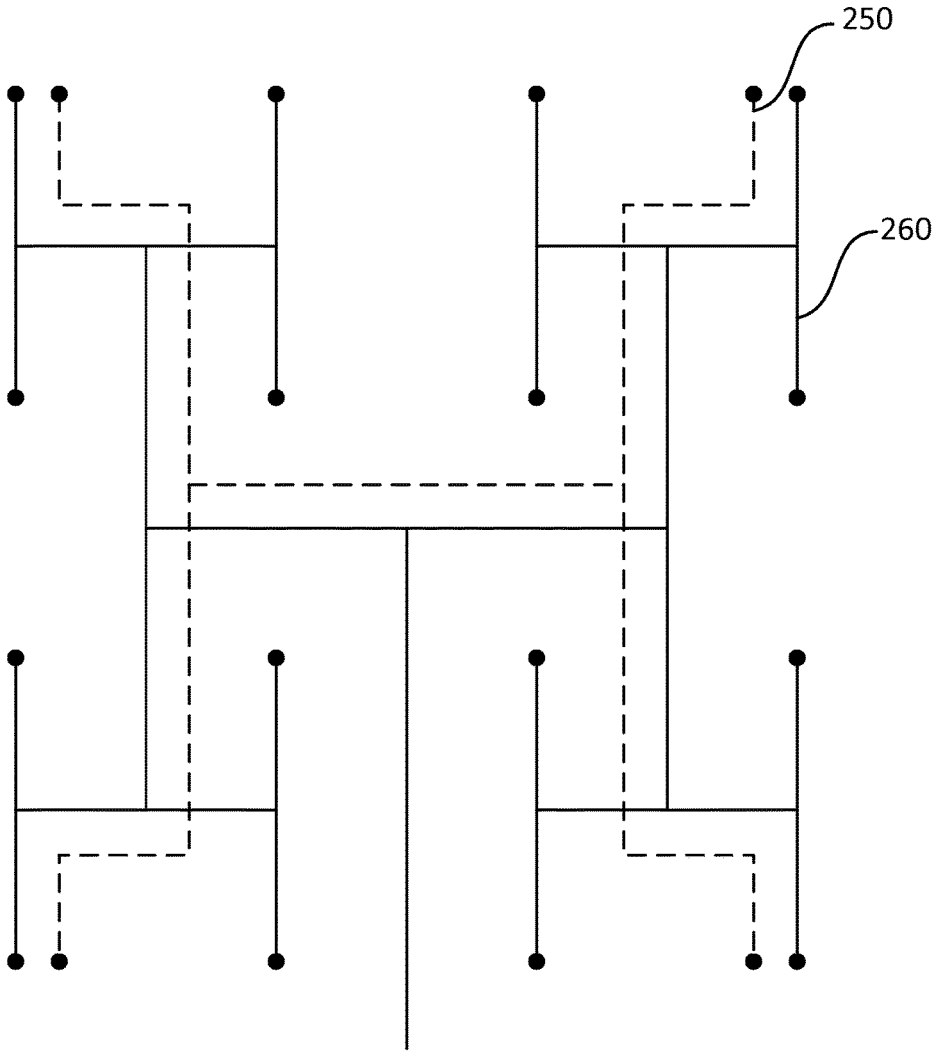
FIG. 2B schematically illustrates a branching feed network for operative coupling to the antenna array of FIG. 2A.

FIG. 2B schematically illustrates a branched transmission line structure for operative coupling to the antenna array of FIG. 2A in accordance with embodiments of the present invention. The structure includes a first branched transmission line structure 250, such as a stripline structure, and a second branched transmission line structure 260, such as a waveguide structure. Each branch of the first and second branched transmission line structures terminates proximate to, for example directly underneath, an antenna element to which it is coupled. Notably, both the first and second branched transmission line structures include branches terminating proximate to the combination antenna elements 200, thereby allowing these combination antenna elements to be coupled to both of the branched transmission line structures. In contrast, only the second branched transmission line structure includes branches terminating proximate to the remaining antenna elements 210 of the antenna array. It is noted that the illustrated branched transmission structure is substantially symmetric. For example, the path lengths between a common port of the structure and the multiple antenna-coupled ports are substantially equal. This may assist in driving the multiple antenna elements of the array in phase.

Figure 2C:
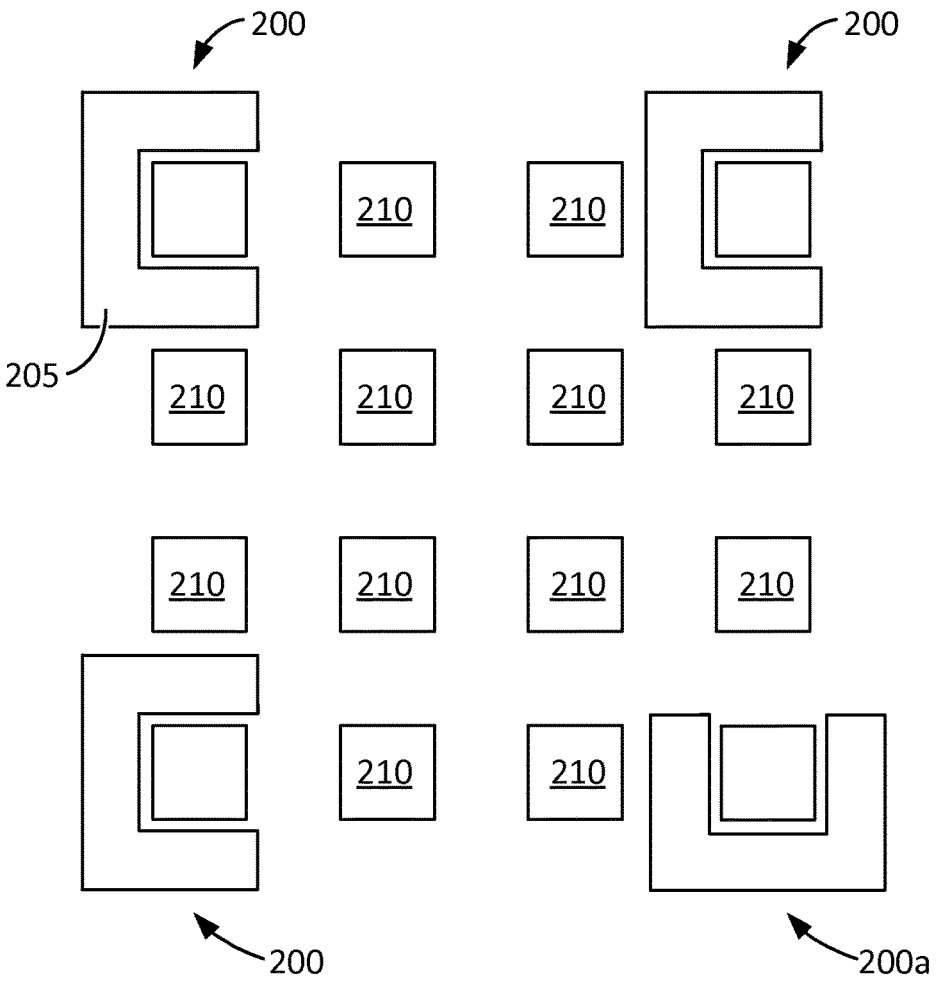
FIG. 2C illustrates a dual-band antenna array provided in accordance with some embodiments of the present invention.

FIG. 2C illustrates an antenna array or sub-array portion thereof in accordance with an embodiment of the present invention. The antenna array or sub-array portion comprises combination antenna elements 200 interleaved with other antenna elements 210. In this embodiment, one of the combination antenna elements 200*a*, has been rotated relative to the other combination antenna elements 200. As would be readily understood, plural combination antenna elements may be rotated relative to the other combination antenna elements within the antenna array or sub-array portion. While FIG. 2C illustrates a 90 degree rotation of combination antenna element 200*a* relative to the other antenna elements 200, other angles of relative rotation are possible. Furthermore, in embodiments where multiple combination antenna elements are rotated relative to other combination antenna elements, the angle of rotation of a first combination antenna element may be different from the angle of rotation of another combination antenna element.

Figure 3:
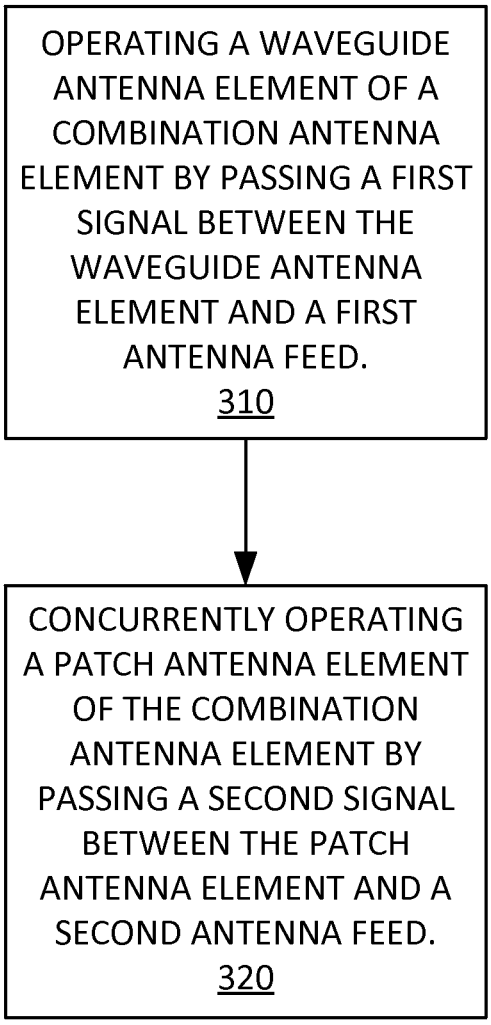
FIG. 3 illustrates a method for wireless communication provided in accordance with embodiments of the present invention.

Some embodiments of the present invention provide for a method for wireless communication, for example as illustrated in FIG. 3. The method includes operating 310 a waveguide antenna element of a combination antenna element by passing a first signal between the waveguide antenna element and a first antenna feed. In particular, the first antenna feed propagates signals according to a first electromagnetic propagation mode, and the waveguide antenna element is operative in a first frequency band. The method also includes concurrently operating 320 a patch antenna element of the combination antenna element by passing a second signal between the patch antenna element and a second antenna feed. In particular, the second antenna feed propagates second signals according to a second electromagnetic propagation mode different from the first electromagnetic propagation mode. Further, the patch antenna element is operative in a second frequency band which may be different from the first frequency band. For example the first frequency band may be higher than the second. More specifically, the first frequency band may be an E-band and the second frequency band may be an LMDS band.

Microstrip Patch Antenna Element

Figure 4:
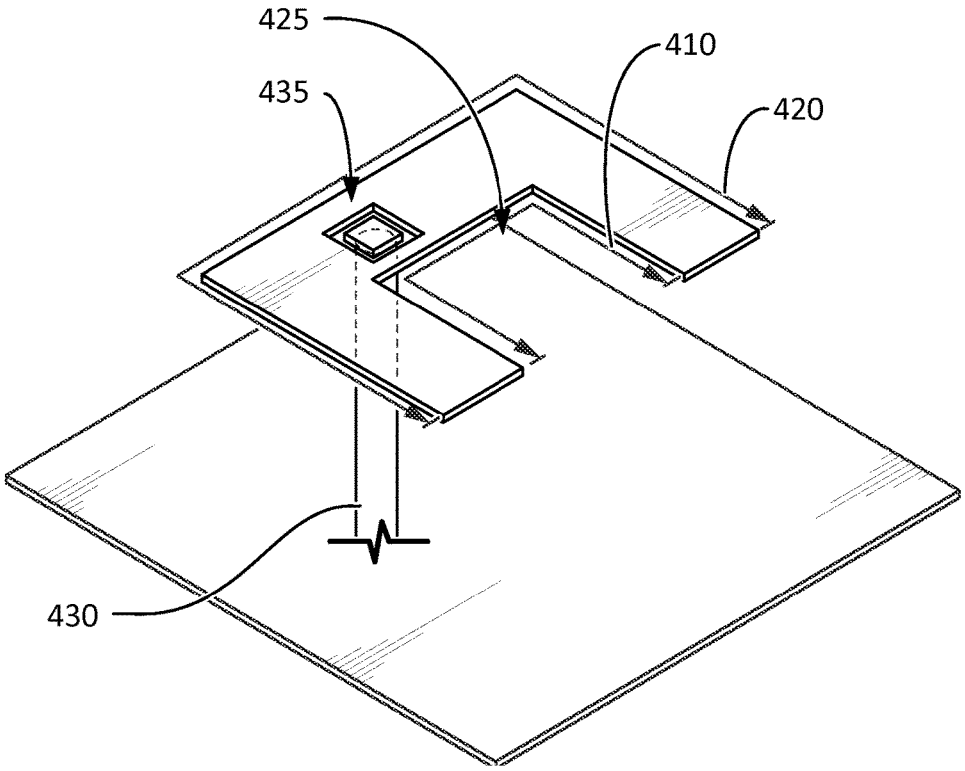
FIG. 4 illustrates a perspective view of a microstrip patch antenna (MPA) component provided as part of a combination antenna element in accordance with some embodiments of the present invention.

FIG. 4 illustrates a perspective view of a microstrip patch antenna (MPA) component provided as part of a combination antenna element in accordance with some embodiments of the present invention. The MPA may be configured to operate in a desired band, for example the LMDS band. In various embodiments, the percentage bandwidth of the antenna is configured at about 20%. In one embodiment, the bandwidth is about 6 GHz, centred at about 28.5 GHz. As illustrated, the MPA includes an inner perimeter 410 and an outer perimeter 420, which correspond to two different perimeters which create two relatively close resonances, for example at about 26.5 GHz and 31 GHz. This may facilitate achievement of the desired bandwidth. The inner perimeter 410 and the outer perimeter 420 are substantially parallel and communicate with each other to form an open perimeter defining an interior region 425 adjacent to the inner perimeter.

A via 430 is illustrated as an antenna feed. The body of the MPA may be provided as a feature in a PCB layer, while the via 430 extends to couple the MPA to a multi-conductor transmission line located at another layer of the PCB. In some embodiments, a relatively high inductance of the via 430 is compensated for by a capacitive coupling of the via to the MPA body implemented via a slot 435 formed between the via and the MPA body in the plane of said MPA body. The location of the via 430 may be configured and optimized for desired operation of the MPA in presence of other nearby antenna elements, such as the waveguide element described elsewhere herein. As illustrated, the via 430 is located proximate to a corner of the inner perimeter 410. The via feed allows for separation of the MPA and the waveguide and may assist in further isolation between the MPA and the waveguide.

Figure 5:
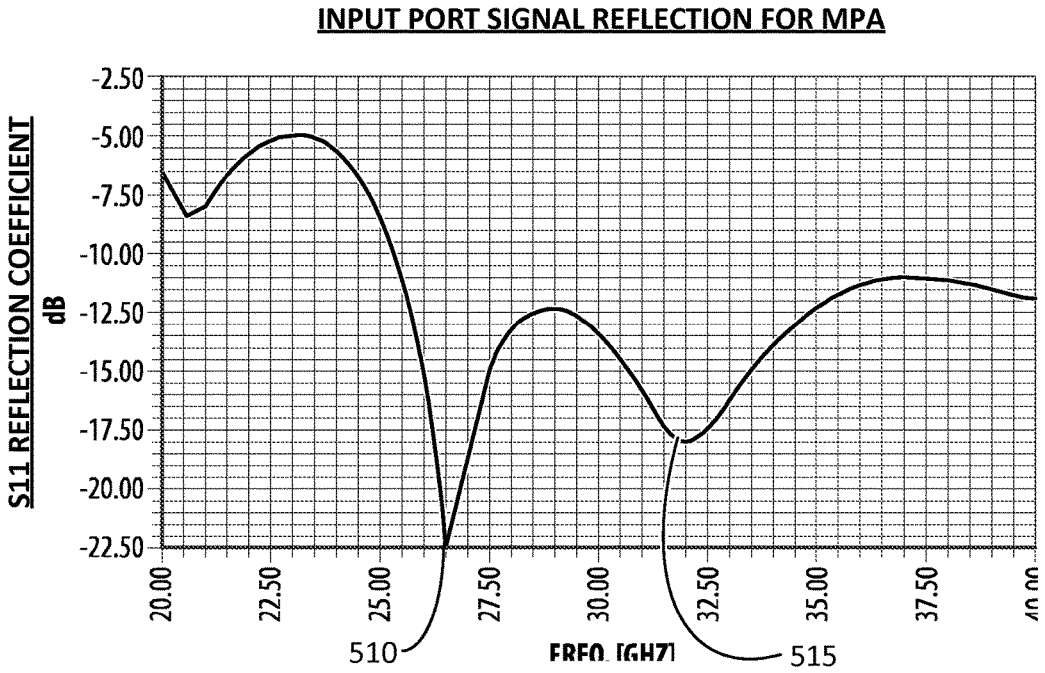
FIG. 5 graphically illustrates frequency response of the MPA illustrated in FIG. 3, in accordance with some embodiments of the present invention.

FIG. 5 graphically illustrates a plot of the reflection coefficient of the antenna in dB, also referred to as S11, versus frequency for the MPA illustrated in FIG. 3. Regions of lower reflectance may be associated with a desirable impedance matching of the antenna. The resonances at about 26.5 GHz and 31 GHz are visible as local minima 510 and 515 in the graph, respectively. As also illustrated, the reflected signal response curve is below −10 dB, thus for example exhibiting a desirable impedance matching, for the frequency region extending from about 25 GHz to past 40 GHz, which corresponds to a relatively broadband frequency range for the MPA. This frequency response curve is due in part to the shape of the MPA and in part to the location of the via pad feed and the capacitive coupling to the via pad feed.

Figure 6:
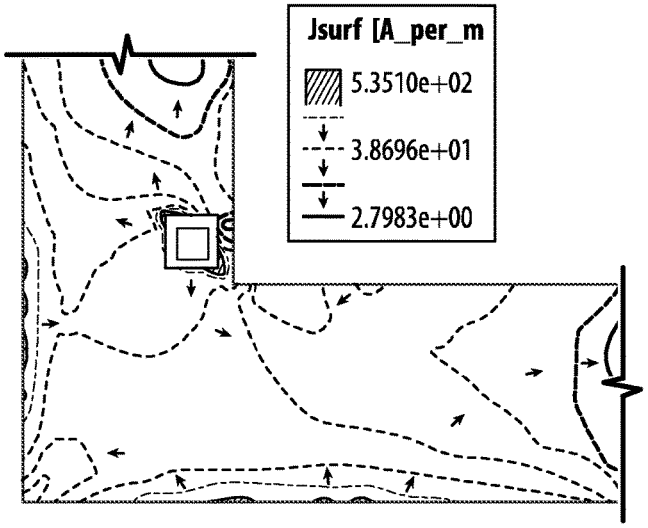
FIG. 6 illustrates surface current density for a portion of the MPA illustrated in FIG. 3, in accordance with some embodiments of the present invention.

FIG. 6 illustrates relative electric current distribution for a portion of the MPA illustrated in FIG. 4. The current distribution corresponds to the operating frequency of the MPA. Notably, electric current and hence power is generally lower along the MPA inner perimeter. As such, it is more feasible to place an antenna element in line with the MPA interior region than would otherwise be the case.

Waveguide Antenna Element

Figure 7:
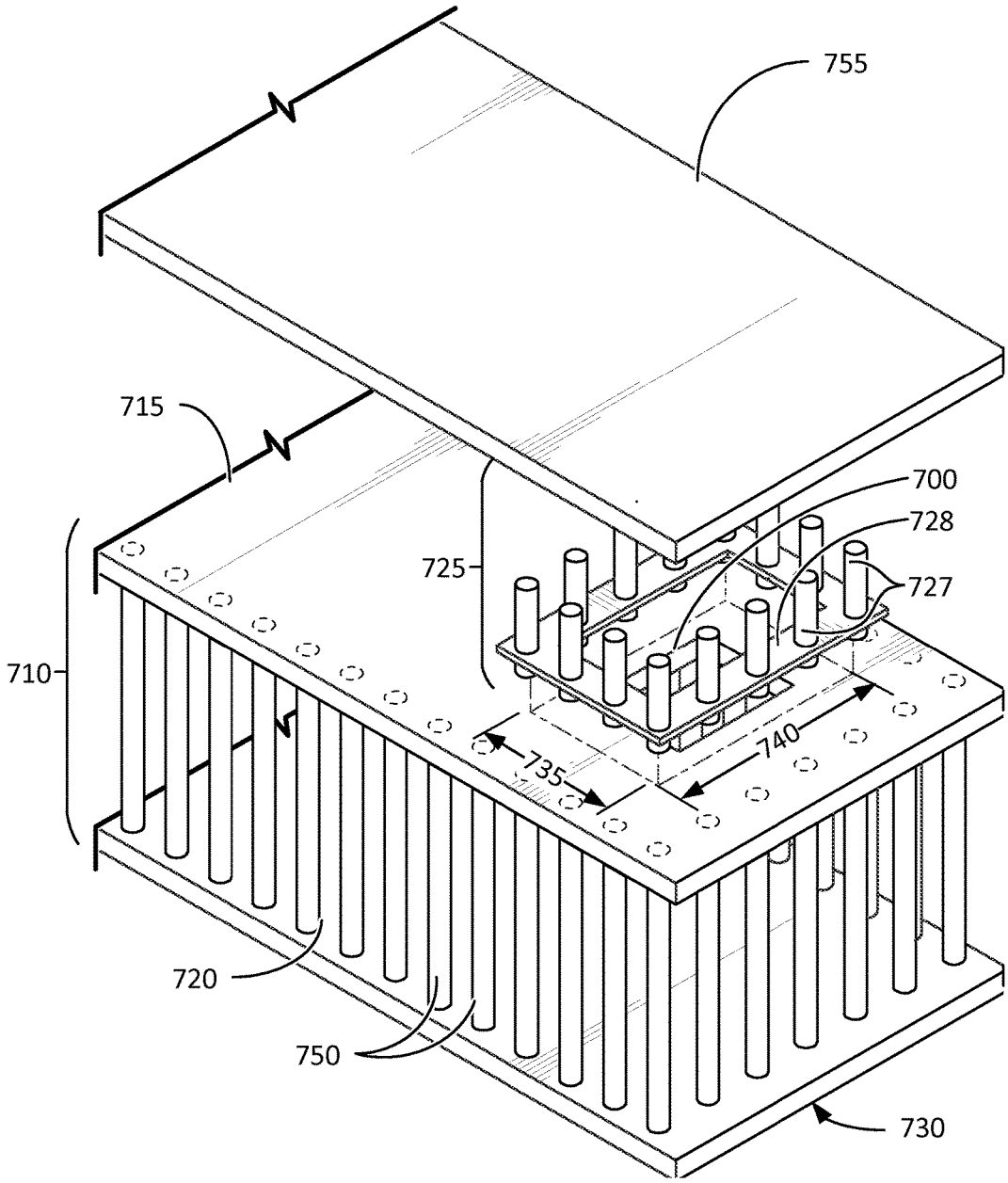
FIG. 7 illustrates a waveguide antenna element operatively coupled to a substrate integrated waveguide (SIW), in accordance with some embodiments of the present invention.

FIG. 7 illustrates a waveguide antenna element 700 operatively coupled to a substrate integrated waveguide (SIW) 710, both features being incorporated into a multilayer PCB, in accordance with some embodiments of the present invention.

The SIW 710 comprises a pair of ground planes 715, 720, connected by vias 750, such as buried vias to form a boundary of the SIW. The waveguide antenna element 700 comprises a slot formed in an upper one of the ground planes 715, for example by etching of the ground plane at the appropriate location. The waveguide antenna further comprises a radiating aperture 725 having metallic vias 727 such as buried vias. The radiating aperture 725 is coupled to the SIW via the slot 700. The vias 727 may be electrically connected to each other by a conductive body 728 for example formed on an appropriate PCB layer. In some embodiments, the radiating aperture may be coupled to the upper ground plane 715. Also illustrated is an outer PCB surface 755, illustrating that the SIW and waveguide antenna element may be provided within internal layers of a multilayer PCB. The radiating aperture 725 provides a waveguide antenna portion extending perpendicularly from the ground plane 715.

The waveguide antenna element 700, which may be configured for operation in the E-band, may correspond to a 90 degree bend in signal transmission from the SIW 710. The SIW may therefore terminate at the edge 730 proximate to an edge of the antenna element 700. The termination at edge 730 may be provided for by provision of the vias 750 along the edge 730, for example to provide for an SIW short. In some embodiments, edges of the SIW, such as the terminal edge 730 and side edges corresponding to location of the vias 750 may be located about ¼ of an operating wavelength from the slot of the waveguide antenna element.

In an alternative embodiment, the entire SIW may be configured to undergo a 90 degree bend prior to termination at the waveguide antenna element. For example, rather than the waveguide antenna element being formed as a slot within the ground plane 715, the antenna element may be formed as a slot within another PCB plane situated between the ground plane 715 and the PCB surface 755. The slot may be surrounded by a conductive region having a width of at least ¼ of an operating wavelength. Vias may connect the edge of the conductive region to the ground planes 715 and 720 to provide the perimeter of the 90 degree bent portion of the SIW.

In some embodiments, rather than terminating the SIW at edge 730, the waveguide may continue past the antenna element for at least a predetermined distance, for example in order to provide for part of a slotted waveguide and/or a resonant cavity of the waveguide.

As mentioned above, the waveguide antenna element or alternatively the slot thereof may have a width 735 of about 0.6 mm and a length 740 of about 1.2 mm. The SIW may correspondingly also have a width of about 1.2 mm. More generally, the waveguide antenna element is dimensioned such that it fits within (but offset from) the interior region of the MPA as described elsewhere herein. In accordance with some embodiments of the present invention, the waveguide antenna element and MPA are selected and co-configured so that this spatial relation, namely the waveguide antenna fitting within but offset from an interior region of the MPA, is possible, in addition to operating adequately within the desired frequency ranges, such as LMDS and E-band frequency ranges. In various embodiments, combination of physical and operational features may facilitate provision of an antenna array with desirable operational characteristics and industrial applicability.

Figure 8:
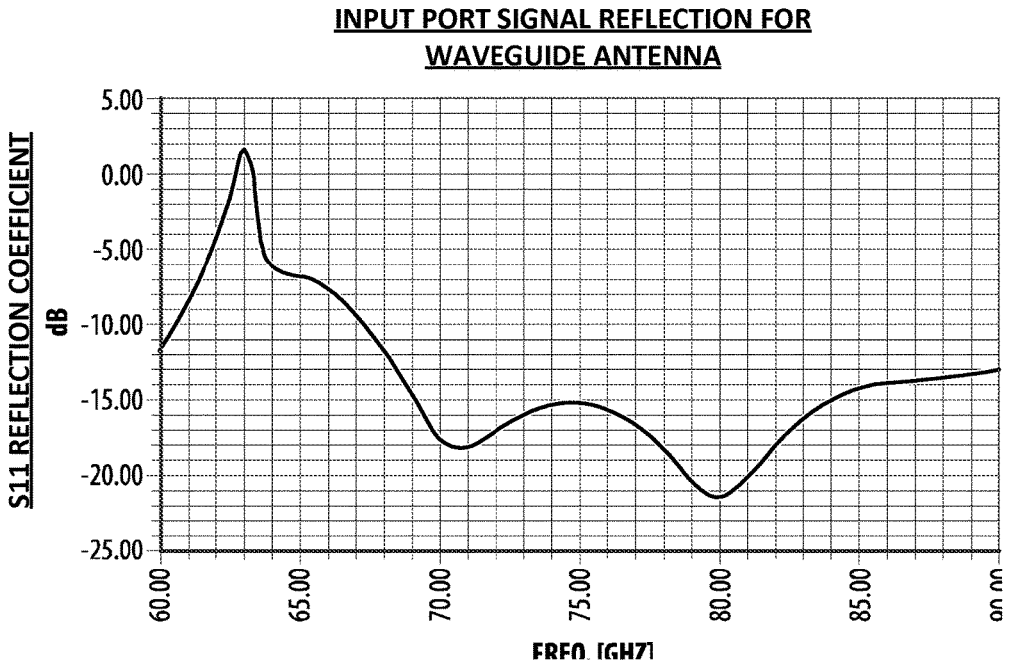
FIG. 8 graphically illustrates frequency response of the waveguide antenna illustrated in FIG. 7, in accordance with some embodiments of the present invention.

FIG. 8 graphically illustrates a plot of SIW (in dB), the reflection coefficient, versus frequency for the waveguide antenna illustrated in FIG. 7. As illustrated, the reflection coefficient curve is below −10 dB, (thus exhibiting desirable impedance matching of the antenna) for a frequency range which includes the desired E-band range from 71 GHz to 86 GHz and indeed extends beyond this range.

Co-Design of Antenna Elements

In various embodiments, the first antenna element and the second antenna element are at least partially configured to operate in presence of one another. As such, the two antenna elements may be co-optimized. Co-optimization may be constrained optimization, and generally comprises a co-design of the two antenna elements so as to operate adequately when in close proximity. For example, the location of the feed to the MPA element may be adjusted to achieve desired MPA performance when a waveguide antenna is aligned with, the interior region of the crescent-shaped MPA. Other physical dimensions of the elements can be similarly adjusted for example to optimize the antenna elements each in presence of the other. It is noted that the MPA may be physically larger in surface area than the waveguide antenna, in order to provide for alignment of the waveguide antenna within the interior region of the MPA.

Figure 9:
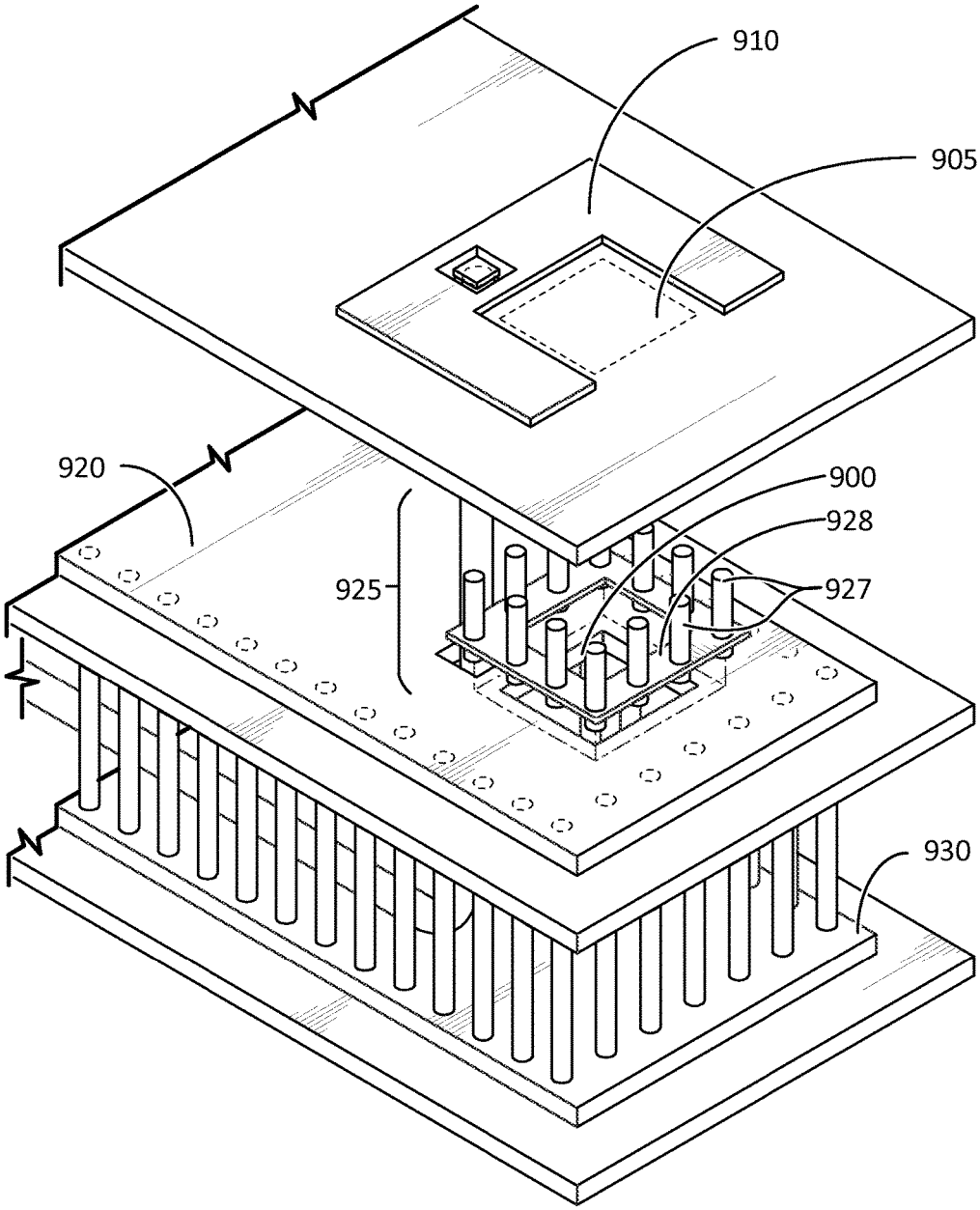
FIG. 9 illustrates a perspective view of the above arrangement of a waveguide antenna aligned with an interior region of an MPA, in accordance with some embodiments of the present invention.

FIG. 9 illustrates a perspective view of the above arrangement of a waveguide antenna aligned with an interior region 905 of the crescent-shaped MPA 910, in accordance with some embodiments of the present invention, which is also comparable to the arrangement illustrated in FIG. 1. FIG. 9 further illustrates an SIW having upper and lower ground planes 920, 930, the SIW operatively coupled to the waveguide antenna. Vertical dimensions have been exaggerated for clarity.

The waveguide antenna comprises a coupling slot 900 formed within the upper ground plane 920. The waveguide antenna further comprises a radiating aperture 925 having metallic vias 927 such as buried vias. The radiating aperture 925 is coupled to the SIW via the coupling slot 900. Further, a perimeter of the radiating aperture, when projected onto the plane 920, may enclose a perimeter of the slot 900. The vias 927 may be electrically connected to each other by a conductive body 928 for example formed on an appropriate PCB layer. In various embodiments, the radiating aperture 925 may be aligned with the interior region 905 in the sense that that the perimeter of the radiating aperture, when projected onto the plane in which the interior region 905 lies, is coincident with or falls within the interior region 905.

In some embodiments, the MPA may be fed via a stripline enclosed within the waveguide and coupled to the MPA by a metallic via connection. The MPA may therefore be proximate to the waveguide and the waveguide aperture antenna. In some embodiments, the MPA may be configured to radiate primarily in its outer edges or corners, rather than along the perimeter of its interior region. It is recognized herein that such a configuration may be achieved by appropriate placement of the via feed coupled to the "C"-shaped MPA. As such, the edges of the MPA interior region may radiate at a substantially lesser intensity. Consequently, presence of a waveguide aperture antenna aligned with the interior region of the MPA may have limited effect on the radiation and impedance characteristics of the MPA and vice-versa. This approach can facilitate close placement of the MPA and waveguide aperture antenna while still allowing for adequate operation of both antennas.

In some embodiments, the via feed of the "C"-shaped MPA is located proximate to an internal corner of the interior region perimeter. Further, the via feed may be capacitively coupled to the MPA for example by separating the via feed from the MPA body by a gap, such as a gap formed in the plane of the MPA body around a portion of the via feed located in the same plane. Appropriate placement of the via feed may be determined and tuned for example through simulation, in order to determine a via feed configuration which results in a desirably low amount of radiation of the MPA along the perimeter of the interior region.

Figure 10:
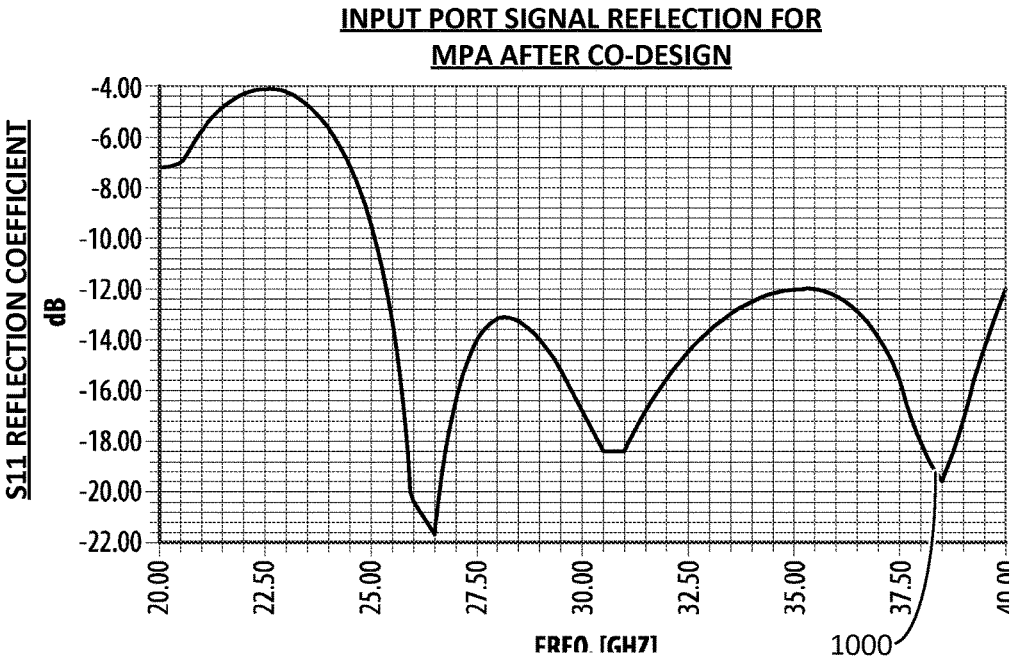
FIG. 10 graphically illustrates frequency response of the MPA as illustrated in FIG. 9, in accordance with some embodiments of the present invention.

FIG. 10 graphically illustrates a plot of SIW (in dB) the reflection coefficient versus frequency for the MPA as illustrated in FIG. 9, according to some embodiments of the present invention. The curve is comparable to that of FIG. 4, but in fact exhibits a wider frequency bandwidth of impedance matching due to a further local minimum 1000 at about 38.5 MHz. This may be due to the presence of a higher effective ground or more physically distant ground plane relative to the interior region of the MPA, as introduced by the aperture formed by the waveguide antenna.

As such, some embodiments of the present invention provide for inclusion of an aperture or waveguide antenna in line with an interior region defined by a patch antenna having a perimeter, such as an open perimeter, the aperture or waveguide antenna being located on a different plane from a radiating body of the patch antenna. This configuration may result in an increased impedance bandwidth of the patch antenna while also facilitating re-use of the interior region of the patch antenna for electromagnetically accessing the aperture or waveguide antenna, for example by conceptually providing a "window" in the patch antenna body which is in line with a radiated field of the waveguide aperture antenna element, thereby substantially inhibiting the MPA from obstructing a major portion of this radiated field. Thus, a three-dimensional structure providing two antennas facing a common plane can be provided.

Figure 11:
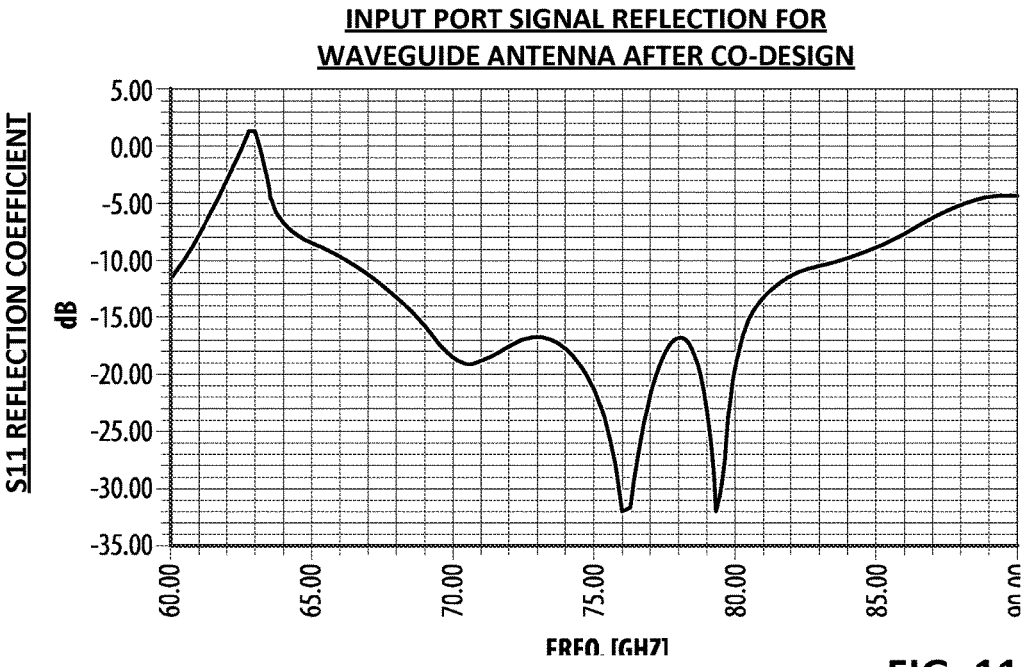
FIG. 11 graphically illustrates frequency response of the waveguide antenna as illustrated in FIG. 9, in accordance with some embodiments of the present invention.

FIG. 11 graphically illustrates a plot of S11 (in dB) the reflection coefficient versus frequency for the waveguide antenna as illustrated in FIG. 9. The curve is comparable to that of FIG. 8.

In various embodiments, optimizing of the waveguide antenna in presence of the MPA comprises tuning the dimensions thereof. For example, width and length of the SIW may be configured in order to provide for a desired operating frequency band. In addition, the location of the slot opening may also be configured in order to affect the operating frequency band. Tuning of the dimensions may be motivated by the presence of the main patch body of the MPA above the waveguide antenna as well as the thickness of the substrate layer overtop of the waveguide slot in various PCB implementations which require additional layers formed overtop of the waveguide slot.

Figure 12:
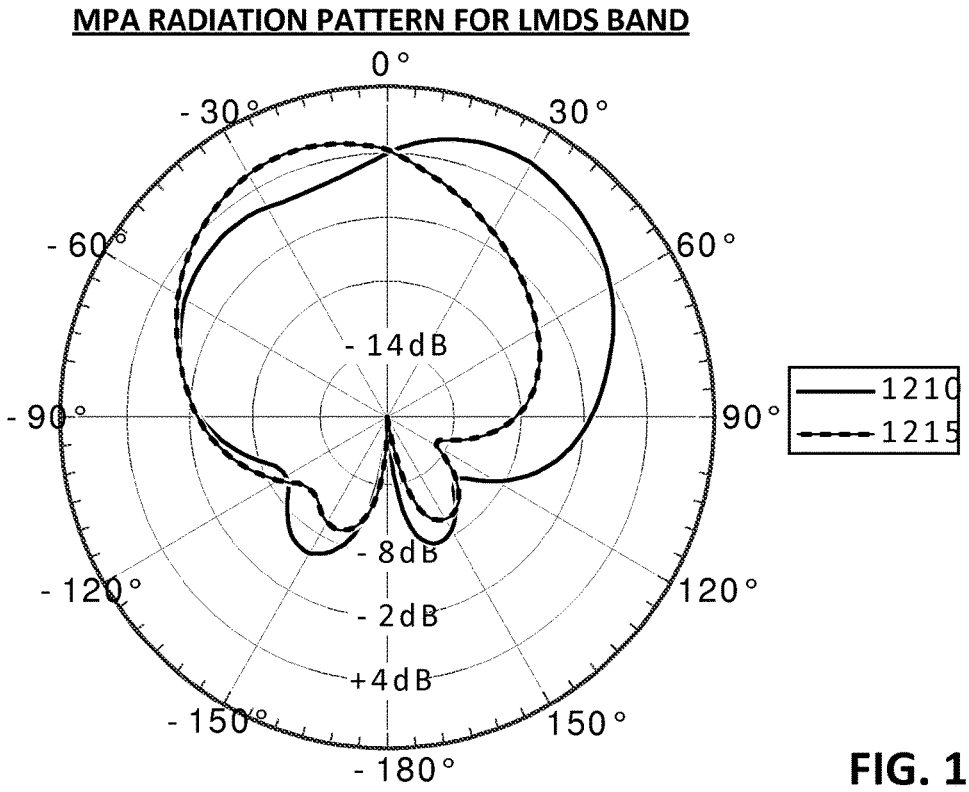
FIG. 12 illustrates the radiation pattern for the MPA in presence of the waveguide antenna and configured for operation in the LMDS band, in accordance with some embodiments of the present invention.

FIG. 12 illustrates the radiation pattern for the MPA in presence of the waveguide antenna and configured for operation in the LMDS band, in accordance with some embodiments of the present invention as described herein. Curve 1210 illustrates the gain, in dB, of the MPA in the azimuthal plane, while curve 1215 illustrates the gain, in dB, of the MPA in the elevation plane. Gain is measured for a frequency of about 30 GHz. Some tilting of the radiation pattern is observed potentially due to asymmetry corresponding to introduction of the waveguide element. In various embodiments this may be corrected by use of an adequately large array of antenna elements, for example to shift the aggregate radiation pattern closer to one having a maximum at broadside.

Figure 13:
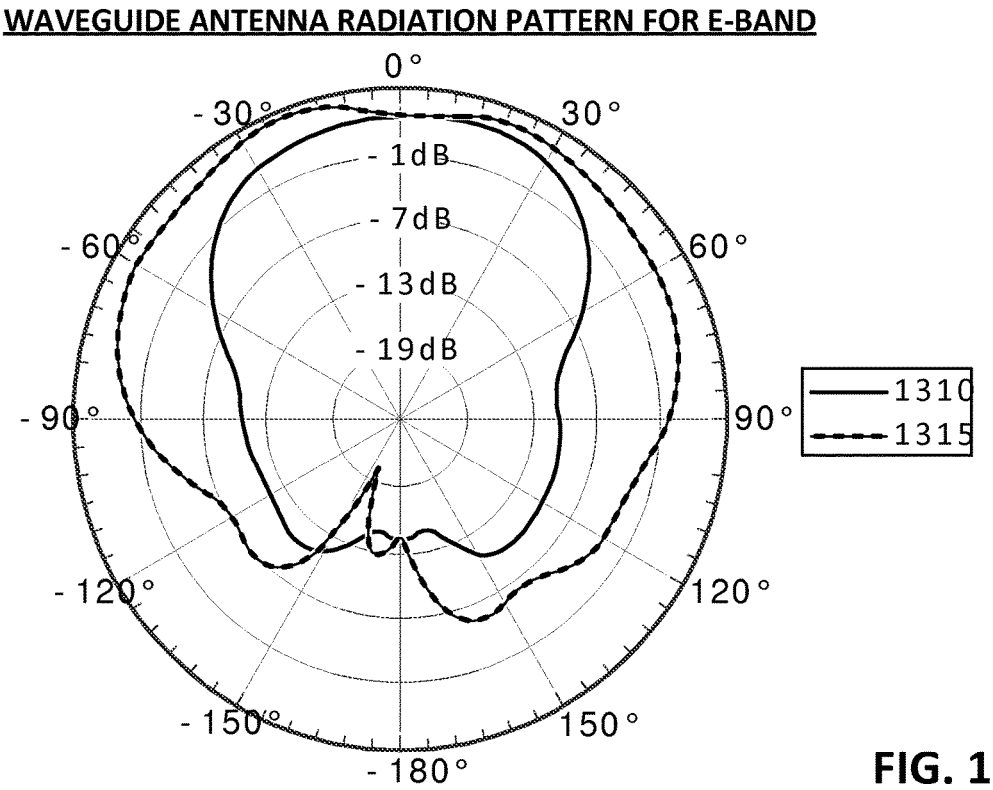
FIG. 13 illustrates the radiation pattern for the waveguide antenna in presence of the MPA and configured for operation in the E-band, in accordance with some embodiments of the present invention.

FIG. 13 illustrates the radiation pattern for the waveguide antenna in presence of the MPA and configured for operation in the E-band, in accordance with some embodiments of the present invention as described herein. Curve 1310 illustrates the gain, in dB, of the waveguide antenna in the azimuthal plane, while curve 1315 illustrates the gain, in dB, of the waveguide antenna in the elevation plane. Gain is measured for a frequency of about 86 GHz. Some side leakage of the radiating power is observed potentially due to thickness of the substrate overtop of the waveguide aperture, which results in some substrate mode wave propagation. In various embodiments this may be corrected by use of an adequately large array of antenna elements, for example to shift the aggregate radiation pattern.

Figure 14:
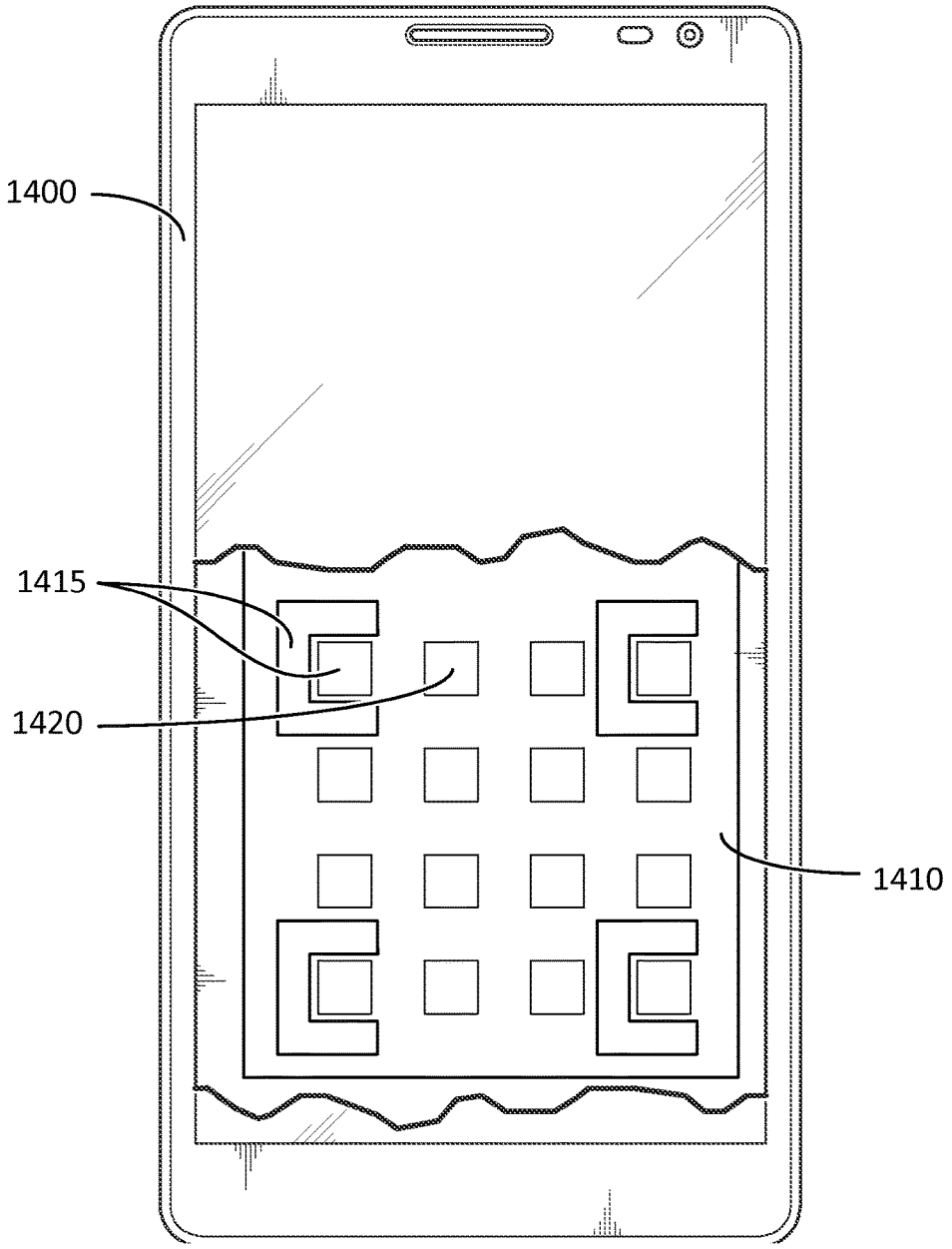
FIG. 14 illustrates a handheld wireless device comprising a combination antenna element provided in accordance with embodiments of the present invention.

FIG. 14 illustrates a handheld wireless device 1400 comprising a combination antenna element provided in accordance with embodiments of the present invention. The wireless device includes a PCB 1410 having an array of antenna elements which includes combination antenna elements 1415 interleaved with additional antenna elements 1420. The combination antenna elements 1415 may include a crescent-shaped MPA on a PCB surface layer and a waveguide antenna element on a PCB interior layer, the waveguide antenna element being aligned within the interior region formed by the crescent of the MPA. The additional antenna elements 1420 may be waveguide antenna elements on the PCB interior layer. Additional antenna elements 1420 may be similar in structure and character to the waveguide antenna element of the combination antenna element 1415. The handheld wireless device 1400 may comprise various operatively interconnected electronic components which can include one or more of signal processing components, control components, RF front-end components, microprocessors, microcontrollers, memory (random access memory, flash memory or the like), integrated circuits, and the like.

Figure 15:
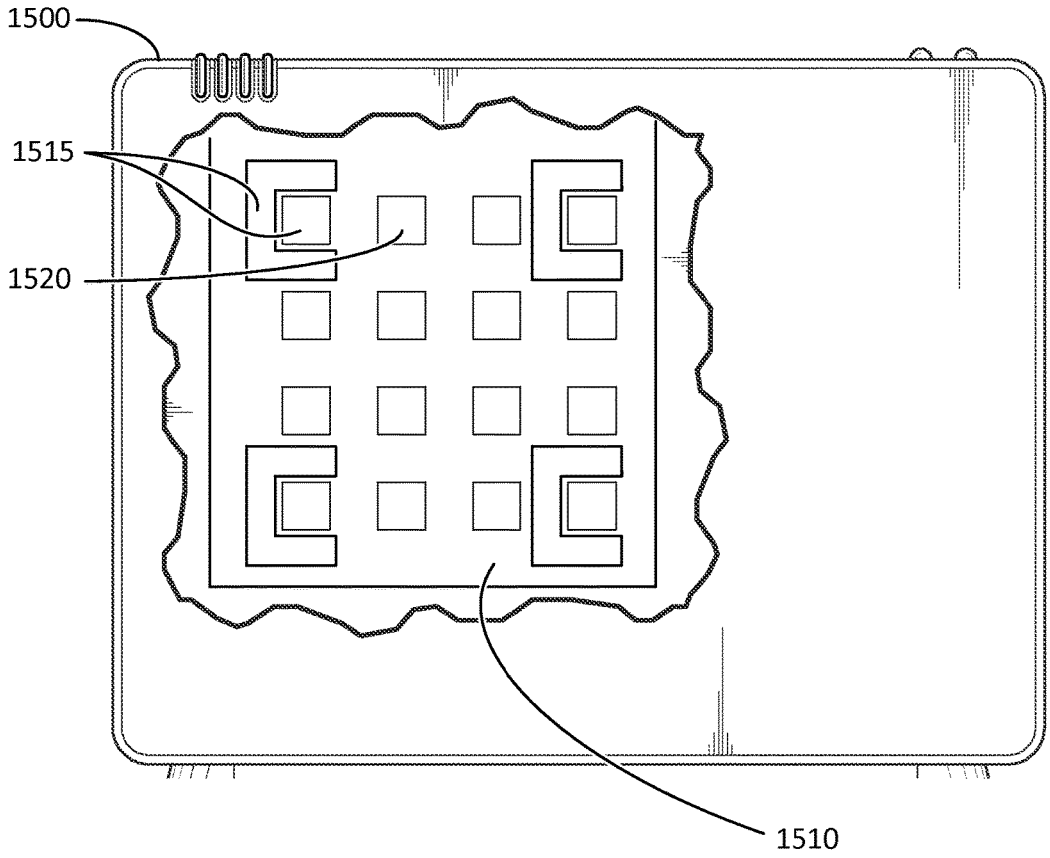
FIG. 15 illustrates a wireless router comprising a combination antenna element provided in accordance with embodiments of the present invention.

FIG. 15 illustrates a wireless router device 1500 comprising a combination antenna element provided in accordance with embodiments of the present invention. A wireless router device as defined herein can be used to refer to a small cell wireless router, for example a router for use in a Local Area Network (LAN) and the like. A wireless router device can further be used to define a device used in network infrastructure, for example a base station, an Evolved Node B (eNB) and the like. The wireless router device includes a PCB 1510 having an array of antenna elements which includes combination antenna elements 1515 interleaved with additional antenna elements 1520, similarly to the PCB 1410 illustrated in FIG. 14. The wireless router device 1500 may comprise various operatively interconnected electronic components which can include one or more of signal processing components, control components, RF front-end components, microprocessors, microcontrollers, memory (random access memory, flash memory or the like), integrated circuits, and the like.

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations or equivalents that fall within the scope of the present invention.

We claim:

1. A combination antenna element comprising:

a first antenna element configured for operative coupling to a first antenna feed and for operation in a first frequency band; and a second antenna element configured for operative coupling to a second antenna feed and for operation in a second frequency band, wherein the second antenna element comprises a perimeter defining an interior region that only partially surrounds the first antenna element;

wherein the first antenna element is a waveguide antenna element and the second antenna element is a patch antenna element.

2. The combination antenna element of claim 1, wherein the perimeter is an open perimeter.

3. The combination antenna element of claim 1, wherein the interior region corresponds to a cavity formed in the second antenna element, the cavity communicating with a pair of opposing faces of the second antenna element, and wherein the portion of the first antenna element is aligned with the cavity along a direction perpendicular to the pair of opposing faces.

4. The combination antenna element of claim 3, wherein the cavity communicates with a further face of the second antenna element connecting to opposing faces.

5. The combination antenna element of claim 1, wherein the first antenna element operates in a first frequency band and the second antenna element operates in a second frequency band, wherein the first frequency band is higher than the second frequency band.

6. The combination antenna element according to claim 1, wherein the waveguide antenna element is a substrate integrated waveguide antenna element.

7. The combination antenna element according to claim 1, wherein the first antenna element and the second antenna element are co-optimized.

8. The combination antenna element according to claim 7, wherein the second antenna is a patch antenna, and wherein said co-optimization includes optimizing placement of a coupling connecting the second antenna with a multi-conductor transmission line feed.

9. The combination antenna element according to claim 1, wherein a coupling between the second antenna feed and the second antenna is a capacitive coupling.

10. A combination antenna element comprising:

a first antenna element configured for operative coupling to a first antenna feed and for operation in a first frequency band; and a second antenna element configured for operative coupling to a second antenna feed and for operation in a second frequency band, wherein the second antenna element comprises a perimeter defining an interior region, wherein at least a portion of the first antenna element is aligned with the interior region;

wherein the first antenna element is a waveguide antenna element and the second antenna element is a patch antenna element; and wherein the patch antenna element is physically larger in surface area that the waveguide antenna element.

11. An antenna array comprising:

one or more combination antenna elements interspersed with one or more additional antenna elements, the one or more combination elements each comprising:

a first antenna element configured for operative coupling to a first antenna feed and for operation in a first frequency band; and a second antenna element configured for operative coupling to a second antenna feed and for operation in a second frequency band, wherein the second antenna element comprises a perimeter defining an interior region that only partially surrounds the first antenna element;

wherein the first antenna element is a waveguide antenna element and the second antenna element is a patch antenna element.

12. The antenna array of claim 11, wherein the perimeter is an open perimeter.

13. The antenna array according to claim 11, wherein the first antenna element and the one of more additional elements operate in a higher frequency band and the second antenna element operates in a lower frequency band.

14. A wireless device comprising:

a combination antenna element including a first antenna element configured for operative coupling to a first antenna feed and for operation in a first frequency band and a second antenna element configured for operative coupling to a second antenna feed and for operation in a second frequency band, wherein the second antenna element comprises a perimeter defining an interior region that only partially surrounds the first antenna element;

wherein the first antenna element is a waveguide antenna element and the second antenna element is a patch antenna element.

15. The wireless device of claim 14, wherein the wireless communication device is a hand held wireless device or a wireless router device.

* * * * *